United States Patent [19]

Pearson et al.

[11] Patent Number: 4,974,756

[45] Date of Patent: Dec. 4, 1990

[54] DOUBLE BARREL DISPENSING CONTAINER AND CAP THEREFOR

[75] Inventors: Walter C. Pearson, St. Paul; Neil J. Schwartzbauer, Hastings, both of Minn.

[73] Assignee: Minnesota Mining and Manufacturing Company, St. Paul, Minn.

[21] Appl. No.: 380,088

[22] Filed: Jul. 14, 1989

[51] Int. Cl.[5] ..... B67D 5/60

[52] U.S. Cl. ..... 222/562; 222/137; 222/145; 222/546; 222/94

[58] Field of Search ..... 222/135, 136, 137, 145, 222/562, 94, 546; 215/295, 329, 340; 220/260, 296, 293

[56] References Cited

U.S. PATENT DOCUMENTS

| | | | |
|---|---|---|---|
| 2,826,339 | 3/1958 | Maillard | 222/137 |
| 3,105,615 | 10/1963 | Koga | 222/145 X |
| 3,166,221 | 1/1965 | Nielson | 222/137 |
| 3,323,682 | 6/1967 | Creighton, Jr. et al. | 222/94 |
| 3,782,600 | 1/1974 | Columbus | 222/94 |
| 4,538,920 | 9/1985 | Drake | 366/177 |
| 4,771,919 | 9/1988 | Ernst | 222/134 |

FOREIGN PATENT DOCUMENTS 0294672 5/1988 European Pat. Off. .

*Primary Examiner*—Andres Kashnikow
*Assistant Examiner*—W. Todd Waffner
*Attorney, Agent, or Firm*—Donald M. Sell; Walter N. Kirn; James D. Christoff

[57] ABSTRACT

A container and cap assembly includes a double barrel dispensing container having two side-by-side outlets, and a cap with two side-by-side closure portions for simultaneously closing both outlets when the cap is connected to the container. The cap includes two protruding orienting sections for orienting the cap relative to the container as the cap is connected to the container. The orienting sections insure that each closure portion comes into contact with the same outlet each time the cap is coupled to the container so that small quantities, if any, of materials flowing through one outlet and deposited on one closure portion of the cap cannot cross-contaminate materials in the remaining barrel after the cap is removed and then re-connected to the container after a dispensing operation.

8 Claims, 2 Drawing Sheets

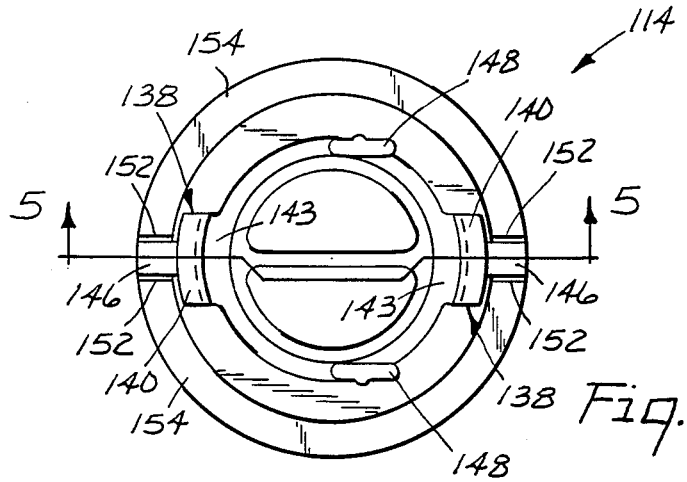
Fig. 4
Fig. 5
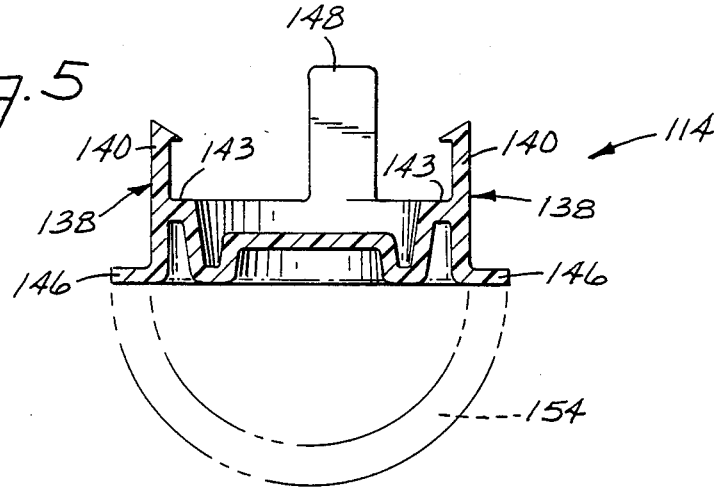

DOUBLE BARREL DISPENSING CONTAINER AND CAP THEREFOR

BACKGROUND OF THE INVENTION

1. Field of the Invention

This invention relates to a double barrel dispensing container and a cap for simultaneously closing both outlets of the container.

2. Description of the Related Art

Double barrel dispensing containers such as double barrel syringes are useful for storing different reactive ingredients which, once dispensed, are mixed together to form a desired composition. As an example, a two barrel container may hold an epoxy resin in one chamber and a curing agent in another chamber, so that portions of the resin and curing agent are simultaneously dispensed for immediate mixing and no measuring of the separate ingredients is necessary.

One example of a double barrel dispensing syringe is described in U.S. Pat. No. 4,538,920 which is assigned to the assignee of the present invention. The syringe has two interconnected plungers for simultaneously dispensing proportioned amounts of material from each barrel. An exit conduit is releasably connected to the syringe and has a plurality of helical mixing elements so that the two ingredients are thoroughly mixed once discharged from the exit conduit and mixing by hand may be avoided.

Typically, only a portion of the materials are dispensed at any one time from the barrels of the syringe shown in U.S. Pat. No. 4,538,920, and it is often desirable to cover the side-by-side outlets of the syringe between dispensing operations in order to prevent undue hardening or drying of the liquid materials therein. In the past, certain dispensing syringes have been provided with caps having threads that receive mating threads surrounding the outlets of the syringe. Other types of double barrel syringes are provided with a unitary cap having flexible, protruding closure portions which releasably fit into side-by-side outlets of the syringe.

However, many conventional caps for double barrel dispensing containers may contribute to cross-contamination of the remaining materials within the barrels. If, for instance, small quantities of the materials within the barrels are deposited on closure portions of the cap covering the syringe outlets, these quantities of materials may react with materials in another barrel if the cap is removed for dispensing and then inadvertently replaced in opposite orientation such that each closure portion of the cap covers an outlet which is different from the outlet previously covered. Although the amount of cross-contamination may be relatively small compared to remaining materials within the barrel, such cross-contamination may lead to hardened lumps within the otherwise liquid mixture when dispensed, and may also hinder passage of the materials along the tortuous path presented by the helical static mixing elements.

One known type of dispensing container cap is shaped for push-on installation on a smooth, cylindrical, protruding neck of a double barrel dispensing container. This type of cap has an inner, cylindrical wall with an elongated slot or recess that receives a radially inwardly extending orientating section which is formed on the neck in order to prevent coupling of the cap to the container unless a certain one of two closure portions on the cap is oriented to close a certain one of the two outlets. While such an arrangement may minimize the possibility of cross-contamination of materials remaining with the container, there is a need for a dispensing container and a cap which may be quickly and securely coupled to the container without the possibility of accidental release from the latter. It would also be desirable if the container was constructed to quickly, releasably lock onto conventional threaded exit conduits when desired.

SUMMARY OF THE INVENTION

The present invention is directed toward a container and cap assembly which includes a double barrel dispensing container having a neck with peripheral threads for connection with an outlet conduit. The neck has a recess extending transversely through the threads, and also has first and second side-by-side outlets for simultaneously dispensing different materials. The assembly also includes a cap having first and second closure portions and coupling structure for releasably connecting the first and second closure portions to the container in order to substantially close the first and second outlets respectively. The cap has a protruding orienting section for reception in the recess in order to orient the cap relative to the container as the cap is connected to the container, and for substantially preventing the second closure portion from closing the first outlet.

The protruding orienting section enables the user to readily observe the latter as the cap is brought near the container so that the user may make adjustment in the position of the cap to permit the orienting section to be received in the recess. The threads of the neck permit quick, secure coupling of the cap, and also permit connections to an exit conduit having a threaded connection end. The recess may also receive an orienting section of an exit conduit which is provided with a loose, captive nut.

BRIEF DESCRIPTION OF THE DRAWINGS

FIG. 4 is an end view of a cap constructed in accordance with another embodiment of the invention; and FIG. 5 is a side cross-sectional view of the cap shown in FIG. 4.

DETAILED DESCRIPTION OF THE DRAWINGS

Figure 1:
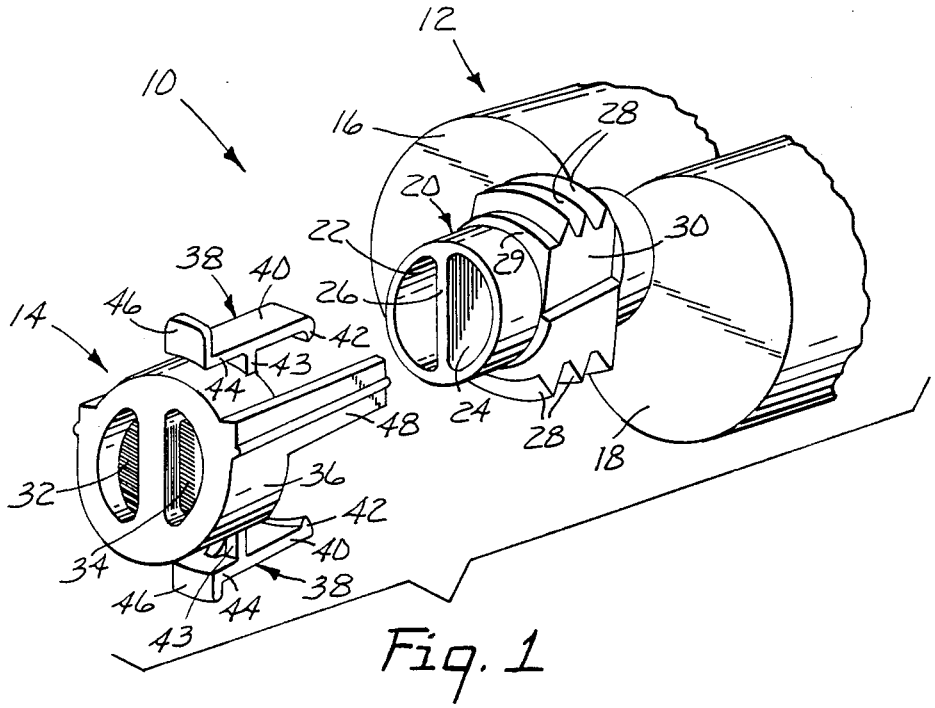
FIG. 1 is a fragmentary, perspective view of the container and cap assembly of the present invention.

A container assembly 10 as shown in FIG. 1 broadly includes a dispensing container 12 and a cap 14. The container 12 has two side-by-side barrels 16,18 which extend in parallel directions, and which each have an internal cylindrical, non-communicating chamber (not shown) for receiving different materials such as liquid reactive ingredients for making an epoxy resin mixture.

The container 12 includes a protruding, somewhat cylindrical neck 20 that presents first and second semi-cylindrical outlets 22,24 which are seprated by a flat barrier 26. The outlet 22 communicates with the chamber within barrel 16, and the adjacent outlet 24 communicates with the barrel 18. The side-by-side outlets 22,24 simultaneously dispense different materials from both chambers as two interconnected pistons (not shown) of the container 12 are simultaneously advanced within the chambers of the barrels 16,18 in a direction toward the neck.

A circumferentially-extending side of the neck 20 has partial, peripheral, double buttress threads 28 which are interrupted by two recesses 30 (only one shown) extending transversely through the threads adjacent the forward end of each barrel 16,18. The threads 28 may receive, if desired, a loose, captive nut for connecting an elongated exit conduit to the container 12. The exit conduit may have internal static mixing elements so that materials expelled from the barrels 16,18 during advancement of the plunger asre thoroughly mixed once discharged from an end of the exit conduit remote from the container outlets 22,24.

Figure 2:
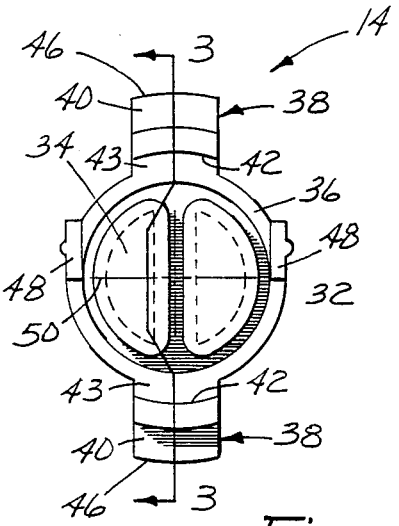
FIG. 2 is an end view of the cap shown in FIG. 1 looking in a direction toward the cap and away from the container.
Figure 3:
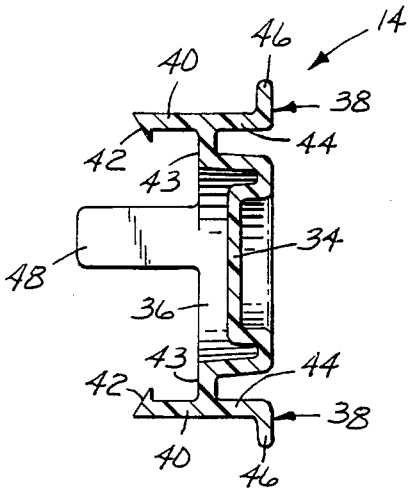
FIG. 3 is a side cross-sectional view of the cap taken generally along line 3—3 of FIG. 2.

The cap 14 has a first closure portion 32 and a second closure portion 34 which can also be seen by reference to FIGS. 2 and 3. The side-by-side closure portions 32,34 project outwardly and have generally semi-cylindrical configurations complemental in shape to the configurations of the outlets 22,24. The closure portions 32,34 are spaced from a surrounding cylindrical housing 36 of the cap 14.

The cap 14 also includes coupling structure 38 for releasably connecting the first and second closure portions 32,34 to the container 12 in order to substantially close the first and second outlets 22,24 respectively. The coupling structure 38 includes a pair of flexible, generally T-shaped arms 40 having hooks 42 on one end for grasping the threads 28 of the container 12. Each of the arms 40 has a finger operating segment 44 remote from the respective hook 42, and each segment 44 is provided with an out-turned flange 46.

The arms 40 are preferably integrally formed with the cap 14 and are resiliently connected to the housing 36 by tabs 43 so that the hooks 42 deflect away from each other and ride over the threads 28 as the cap 14 is pushed onto the neck 20. When desired, the cap 14 may be released from the container 12 by simultaneously pressing both of the segments 44 with the user's fingers toward the housing 36 which causes the hooks 42 to move outwardly and clear the threads 28. The flangles 46 enable the user to then easily pull the cap 14 away from the container 12 in order to remove both of the closure portions 32,34 from their respective positions within the outlets 22,24.

The cap 14 includes a pair of elongated, rectangular orienting sections 48 integrally connected to opposite sides of the housing 36. The orienting sections 48 protrude outwardly from the housing 36 in directions parallel to the longitudinal axis of each arm 40. As the cap 14 is coupled to the container 12 by the arms 40 in order to close the outlets 22,24 the orienting sections 48 slide within and along the length of the respective recesses 30 as long as the cap 14 is oriented in proper relationship relative to the container 12.

As illustrated in FIG. 2, each of the orienting sections 48 is located to one side of a reference line 50 (FIG. 2) passing through the center of the cap 14. Likewise, the recesses 30 are asymmetrically positioned and are located on one side of a reference plane passing perpendicularly through the center of the barrier 26. As a consequence, the orienting sections 48 will slide in the recesses 30 only if the portion 32 is derectly over the first outlet 22 and the portion 34 is directly over the second outlet 24.

When the closure portions 32,34 are not first aligned with the outlets 22,24 respectively, a pair of transverse shoulders 29 will block advancement of the sections 48 and will prevent the cap 14 from being coupled to the container 12. The shoulders 29 are located on the neck 20 between the threads 28 and the outlets 22,24 and extend in a radial direction relative to a central, longitudinal reference axis of the neck 20. The orienting sections 48 extend beyond the arms 40 so that the hooks 42 cannot become caught on the threads 28 if, for example, the cap 14 is improperly positioned relative to the container 12. Advantageously, the recesses 30 and shoulders 29 may also be used with orienting sections of discharge nozzles having static mixers to ensure that the mixers are positioned relative to the container to provide optimum mixing performance. The threads 28 enable the user to quickly connect a threaded outlet conduit to the neck 20 while providing sufficient resistance to withstand the pressure within the conduit which might otherwise tend to inadvertently uncouple the conduit from the container 12.

A cap 114 in accordance with another embodiment of the invention is shown in FIGS. 3 and 4 and includes a pair of orienting sections 148 and coupling structure 138 substantially similar to the sections 48 and the structure 38 described hereinabove. Howerever, each of two arms 140 of the structure 138 has an endmost, narrowed flange 146 which is integrally connected by reduced cross-section webs 152 to ends of two generally C-shaped handles 154. Normally, the handles 154 encircle the remaining portions of the cap 114 as shown in FIG. 4.

The webs connect the handles 154 to the arms 140 for selective pivotal movement about respective axes which are generally perpendicular to the direction of extension of the arms 140. When it is desired to remove the cap 114 from a container such as container 12, the user grasps and pulls the handles 154 which causes the handles 154 to swing about the longitudinal axes of the webs 152 and move from the full-line position in FIG. 4 to outward operating positions, one of which is shown by the phantom lines in FIG. 5. Continued pulling on the handles 154 pivots the arms 140 about flexible tabs 143 which, in turn, moves hooks 142 radially outwardly past threads of the neck of the dispensing container, thereby enabling the cap 114 to be removed from the container. The cap 114 is integrally molded from synthetic resinous materials and the handles 154 return to their normal, inherent positions as indicated by the full lines in FIG. 4 once pressure on the handles 154 is released. As another alternative, a single C-shaped handle could be fixed to the arms 40 near flanges 46 and molded to normally extend outward in the manner of the handle 154 shown by the phantom lines in FIG. 5.

We claim:

1. A container and cap assembly comprising:

a double barrel dispensing container having a neck with peripheral threads for connection with an outlet conduit, said neck having a recess extending transversely through said threads, said neck having first and second side-by-side outlets for simultaneously dispensing different materials; and a cap having first and second closure portions and coupling structrure for releasably connecting said first and said second closure portions to said container in order to substantially close said first and said second outlets respectively, said cap including a protruding orienting section for reception in said recess in order to orient said cap relative to said container as said cap is connected to said container to align said first closure portion with said first outlet and said second closure portion with said second outlet and for substantially preventing said second closure portion from closing said first outlet.

2. The assembly of claim 1, wherein said coupling structure includes a pair of flexible arms having hooks for releasably grasping said threads.

3. The assembly of claim 2, wherein said arms are generally T-shaped and have finger operating segments remote from said hooks, said segments when depressed causing said hooks to release from said threads.

4. The assembly of claim 3, wherein said finger operating segments each include out-turned flanges for pulling said cap away from said container.

5. The assembly of claim 2, wherein said arms and said orienting section extend in generally parallel directions.

6. The assembly of claim 2, wherein said arms are located generally on opposite sides of said cap; and including at least one generally C-shaped handle connected to said arms for pulling said cap away from said neck while releasing said hooks from said threads.

7. The assembly of claim 6, wherein said at least one handle is pivotally connected to said arms for swinging movement about an axis generally perpendicular to the direction of extension of said protruding orienting section.

8. The assembly of claim 1, wherein said orienting section projects outwardly beyond said first and said second closure portions.

* * * * *